US005209823A

United States Patent [19]

Jansma et al.

[11] Patent Number: 5,209,823

[45] Date of Patent: May 11, 1993

[54] WATER-SOLUBLE DISPERSANT WHICH AIDS IN THE DISPERSION OF POLYESTER FIBERS DURING THE PREPARATION OF A WET-LAID NONWOVEN FIBER MAT

[75] Inventors: Roger H. Jansma, Park Forest; James H. Smith, Lisle, both of Ill.

[73] Assignee: Nalco Chemical Company, Naperville, Ill.

[21] Appl. No.: 627,550

[22] Filed: Dec. 10, 1990

Related U.S. Application Data

[62] Division of Ser. No. 417,538, Oct. 5, 1989, abandoned.

[51] Int. Cl.[5] ..... D21H 21/08

[52] U.S. Cl. ..... 162/146; 162/157.2; 162/157.3; 162/164.1; 162/164.7; 162/168.1; 162/168.3; 162/168.7

[58] Field of Search ..... 162/157.2, 157.3, 157.1, 162/146, 158, 164.1, 164.7, 168.3, 168.1, 168.7

[56] References Cited

U.S. PATENT DOCUMENTS

| | | | |
|---|---|---|---|
| 3,067,087 | 12/1962 | Gorski et al. | 162/157.3 |
| 3,416,952 | 12/1968 | McIntyre et al. | 117/118 |
| 3,557,039 | 1/1971 | McIntyre et al. | 260/29.2 |
| 3,712,873 | 1/1973 | Zenk | 524/236 X |
| 3,893,929 | 7/1975 | Basadur | 252/8.6 |
| 4,049,491 | 9/1977 | Brandon et al. | 162/101 |
| 4,200,488 | 4/1980 | Brandon et al. | 162/101 |
| 4,410,687 | 10/1983 | Schimmel et al. . | |
| 4,621,020 | 11/1986 | Tashiro et al. | 162/157.3 |
| 4,738,787 | 4/1988 | O'Lenick et al. | 252/174.23 X |
| 4,834,895 | 5/1989 | Cook et al. | 252/174.19 X |

FOREIGN PATENT DOCUMENTS

| | | |
|---|---|---|
| 58-208500 | 12/1983 | Japan . |
| 63-203875 | 8/1988 | Japan . |

OTHER PUBLICATIONS

Chemical Abstracts, CA 78(16):99021c.
Chemical Abstracts, 242801 49-02801.
Chemical Abstracts, 169738 45-09738.
Chemical Abstracts, 124267 43-04267.

*Primary Examiner*—Peter Chin
*Attorney, Agent, or Firm*—Ailes, Ohlandt & Greeley

[57] ABSTRACT

A water-soluble dispersant which aids in the dispersion of polyester fibers during the preparation of a wet-laid nonwoven fiber mat, the water-soluble dispersant comprising:

polyethylene glycol in an amount greater than about 80% by weight of the water-soluble dispersant:

a phthalic acid ester moiety; and a monomeric glycol, wherein the phthalic acid ester moiety and the monomeric glycol are present in an amount less than about 20% by weight of the water-soluble dispersant.

12 Claims, No Drawings

WATER-SOLUBLE DISPERSANT WHICH AIDS IN THE DISPERSION OF POLYESTER FIBERS DURING THE PREPARATION OF A WET-LAID NONWOVEN FIBER MAT

This is a division of application Ser. No. 417,538, filed Oct. 5, 1989, now abandoned.

BACKGROUND OF THE INVENTION

The present invention provides a novel water-soluble dispersant and process for using such dispersant which aid in the dispersion of polyester fibers during the preparation of a wet-laid nonwoven fiber mat. The water-soluble dispersant comprises: polyethylene glycol in an amount greater than about 80% by weight of the water-soluble dispersant; a phthalic acid ester moiety; and a monomeric glycol, wherein the phthalic acid ester moiety and the monomeric glycol are present in an amount less than about 20% by weight of the water-soluble dispersant.

Various dispersants have been previously used for the purpose of assisting in the dispersion of polyester fibers during the preparation of wet-laid nonwoven fiber mats. These polyester dispersants are typically suspensions of insoluble polymers in water. The conventional dispersants are satisfactory in their application to polyester fiber but have the following disadvantages: (1) manufacture of insoluble dispersants requires the difficult step of preparing a suspension of an insoluble material in water; and (2) due to the insolubility of these dispersants, they are prone to forming troublesome deposits in sheet forming or drying systems.

The following patents and article disclose various dispersing agents used in the dispersion of fibers: U.S. Pat. No. 4,049,491; French Patent No. 2,124,574; U.S. Pat. No. 4,200,488; French Patent No. 2,109,210; German Patent No. 2,056,923 (T. Ashikaga et al.); and Erdelyi, J. et al., "Synthetic Fiber Dispersion and Binder Precipitation in Nonwoven Fabric Production", *Papiripai* 22, No. 1: 3–8 (1978).

U.S. Pat. No. 4,049,491 discloses a uniform polyester nonwoven fabric prepared by agitating aqueous dispersions containing polyester staple fibers and an acrylic or Triton X (polyethylene glycol alkylaryl ether) dispersing agent at high shear, adding an acrylic thickener to the foamed composition, and piling the composition on a net.

French Patent No. 2,124,574 discloses the production of nonwoven textile fleece on a papermaking machine by suspending the synthetic and/or natural fibers in water containing 0.01–3% of a modified polyglycol ether containing 75–99% hydrophilic segments and 1–25% hydrophobic segments. That is, 400 parts polyamide fibers are suspended in 200 parts water containing 0.5% of the reaction product of polyethylene glycol ether, 65:35 2,4- and 2,6-tolylene diisocyanate, and 2 moles of stearyl isocyanate.

U.S. Pat. No. 4,200,488 discloses a wet papermaking process used for forming a nonwoven fabric containing staple length synthetic fibers, e.g., polyester fibers. A high-shear agitated mixture is formed of the fibers, air, and water, together with a dispersant such as an alkylaryl polyether alcohol.

The Erdelyi article discloses that the manufacture of nonwoven fabrics by the wet process depends on two major conditions, i.e., uniform dispersion of the fibers and uniform deposition of binders. Viscose, polyamide, polyester and PAN fibers were dispersed in dispersants, such as, cationic and oxidized starch, cationic polyamide-polyamine, cationic PEI, Busperse 55, Sterogenol, and NaOH-treated Al sulfate in amounts of 0.1–2.0% based on fiber dry weight.

French Patent No. 2,109,210 discloses an aqueous dispersion for making nonwoven material which consists of: 1000 parts water; 100 parts natural, RC or synthetic fibers; 0.5–50 parts of an unsaturated polyester resin; and a dispersing agent in amounts of as much as 25% with respect to the weight of the resin.

German Patent No. 2,056,923 (T. Ashikaga et al.) discloses a wet process for the manufacture of nonwoven fabrics from a suspension of organic synthetic staple fibers which is characterized by the use of compounds of the polyethylene glycol amine or alkyl amine acetate type as dispersing agents for the fibers.

The following patents describe various polymer compositions which are coated on fibers: Japanese Patent Application No. 88/203875; U.S. Pat. No. 3,557,039 (McIntyre et al.) issued on Jan. 19, 1971; U.S. Pat. No. 3,416,952 (McIntyre et al.) issued on Dec. 17, 1968; and U.S. Pat. No. 4,410,687 (Schimmel et al.) issued Oct. 18, 1983.

Japanese Patent Application No. 88/203875 discloses polyester fibers for wet-laid handsheets in which 0.1 wt. % or more block copolyetherester produced from terephthalic acid, ethylene glycol and polyethylene glycol is deposited onto polyester fiber with a multi-layered profile. The block copolyetherester having a degree of polymerization of 3–10 is produced from terephthalic acid, ethylene glycol and polyethylene glycol with molecular weight of 700–3000 at a level of 0.1–1 mole of ethylene glycol. The block copolyetherester is applied to the tow in the form of an aqueous solution of 2 wt. % concentration and thereafter heat treated for 5 minutes at 140° C., followed by cutting into 5 mm lengths to produce the polyester fibers for the handsheets. The polyester-based binder fibers from the aforementioned polyester fibers and Melty were mixed at an 80:20 weight ratio, followed by agitation dispersion in water at 2500 rpm using a pulp defibrator. This produced handsheets which were dried at 140° C. using a drum type drier and then subjected to heat treatment to produce polyester paper.

U.S. Pat. Nos. 3,557,039 and 3,416,952 disclose the coating of polyester shaped articles with an aqueous dispersion of a block or graft copolymer. The first polymeric constituent contains repeat units of the type used in fiber-forming polyester materials and the second polymeric constituent preferably is a polyoxyethylene chain.

U.S. Pat. No. 4,453,314 discloses pigment dispersants for coatings comprising polyesters containing 40–75% oxyalkylene moieties. A polyester dispersant prepared containing 9.6% pentaerythritol, 18.2% phthalic anhydride, 51.2% polyethylene glycol monomethyl ether, and 21% soya fatty acid; an acrylic latex coating formulation containing 1% of the dispersant gave coatings having no blacking resistance.

The aforementioned patents disclose either water-insoluble dispersants or polymer composition used as fiber coatings neither of which describe or suggest the advantage of using a water-soluble dispersant to aid in the dispersion of polyester fibers during the preparation of a wet-laid nonwoven fiber mat. The water-insoluble dispersants have the added disadvantage of requiring difficult steps in preparing a suspension of an insoluble material in water, and also the disadvantage that their insolubility makes them prone to forming troublesome deposits in sheet forming or drying systems.

The present invention overcomes the above mentioned disadvantages, as well as provides additional advantages which shall become apparent as described below.

SUMMARY OF THE INVENTION

A water-soluble dispersant which aids in the dispersion of polyester fibers during the preparation of a wet-laid nonwoven fiber mat. The water-soluble dispersant comprising:

polyethylene glycol in an amount greater than about 80% by weight of the water-soluble dispersant;

a phthalic acid ester moiety; and a monomeric glycol, wherein the phthalic acid ester moiety and the monomeric glycol are present in an amount less than about 20% by weight of the water-soluble dispersant.

The phthalic acid ester moiety is derived from the group consisting of: terephthalic acid, dimethyl terephthalate, isophthalic acid, dimethyl isophthalate, orthophthalic acid, phthalic anhydride, and dimethyl orthophthalate. The monomeric glycol is selected from the group consisting of: ethylene glycol, propylene glycol, neopentyl glycol, and diethylene glycol.

An additional object of the present invention is a process for forming a wet-laid nonwoven fiber mat comprising the steps of:

adding a water-soluble dispersant to water, the water-soluble dispersant comprising: polyethylene glycol in an amount greater than about 80% by weight of the water-soluble dispersant; a phthalic acid ester moiety; and a monomeric glycol, wherein the phthalic acid ester moiety and the monomeric glycol are present in an amount less than about 20% by weight of the water-soluble dispersant;

adding fibers to the water subsequent to addition of the water-soluble dispersant, thereby forming a fiber slurry;

mixing the fiber slurry; and forming a wet-laid nonwoven web from the mixed fiber slurry.

The water-soluble dispersant is added to the fibers in an amount in the range between about 0.02 to 5% of active solids based on fiber weight, more preferably between about 0.04 to 1% of active solids based on fiber weight.

Optionally, a viscosity modifier may be added to the water prior to addition of the fibers.

The present invention may also include many additional features which shall be further described below.

DESCRIPTION OF THE PREFERRED EMBODIMENTS

The present invention provides a novel water-soluble dispersant and process for using such dispersant which aid in the dispersion of polyester fibers during the preparation of a wet-laid nonwoven fiber mat. The water-soluble dispersant comprises: polyethylene glycol in an amount greater than about 80% by weight of the water-soluble dispersant; a phthalic acid ester moiety; and a monomeric glycol, wherein the phthalic acid ester moiety and the monomeric glycol are present in an amount less than about 20% by weight of the water-soluble dispersant.

The terpolymer dispersants of the present invention can be prepared using polyethylene glycol, a monomeric glycol, and one or more of the phthalate acids (usually using their dimethyl ester as the starting point). The polymerization is carried out via condensation of these materials at high temperature using appropriate catalysis and eliminates water and/or methanol. The molar ratios are chosen such that sufficient polyethylene glycol is incorporated to produce a water-soluble polymer or oligomer.

The present inventors have discovered that if the amount of polyethylene glycol initially charged to the reaction mixture is greater than about 80% of the finished product weight (after distillation of by-products), the product is likely to be water-soluble and thus a dispersant according to this invention. The balance of less than 20% of the finished product weight is made up of the phthalic acid ester moiety and the monomeric glycol, e.g., ethylene glycol.

The phthalic acid ester moiety can be derived from: terephthalic acid, dimethyl terephthalate, isophthalic acid, dimethyl isophthalate, orthophthalic acid, phthalic anhydride, and dimethyl orthophthalate. The monomeric glycol is selected from the group consisting of: ethylene glycol, propylene glycol, neopentyl glycol, and diethylene glycol.

The water-soluble dispersant is preferably the distillation product of polyethylene glycol, dimethyl terephthalate, ethylene glycol, butylated hydroxy toluene, calcium acetate hydrate, antimony trioxide, and a 25% solution of phosphorous acid dissolved in ethylene glycol. It may also be the distillation product of polyethylene glycol, terephthalic acid, ethylene glycol, and antimony trioxide.

A solution of the water-soluble dispersant is added to a fiber mixture containing polyethylene terephthalate ("polyester") fibers and possibly other synthetic and/or natural fibers. Addition rates may be as high as 5% based on fiber to well under 1% depending on the specific application circumstance.

The preferred process for forming a wet-laid nonwoven fiber mat according to the present invention comprises the following steps:

adding a water-soluble dispersant to water, the water-soluble dispersant comprising: polyethylene glycol in an amount greater than about 80% by weight of the water-soluble dispersant; a phthalic acid ester moiety; and a monomeric glycol, wherein the phthalic acid ester moiety and the monomeric glycol are present in an amount less than about 20% by weight of the water-soluble dispersant;

adding fibers to the water subsequent to addition of the water-soluble dispersant, thereby forming a fiber slurry;

mixing the fiber slurry; and forming a wet-laid nonwoven web from the mixed fiber slurry.

The water-soluble dispersant is added to the fibers in an amount in the range between about 0.02 to 5% of active solids based on fiber weight, more preferably between about 0.04 to 1% of active solids based on fiber weight.

Optionally, a viscosity modifier may be added to the water prior to addition of the fibers. The viscosity modifier is preferably a polyacrylamide viscosity modifier. Typically, the viscosity modifier is added in an amount of about 10–100 ppm based on the total volume of water.

The invention can be better understood by referring to the below examples.

EXAMPLE 1

(Compound A)

The following ingredients were put into a one-liter resin flask equipped with stirrer, thermometer, distillation head with condenser, and heating mantle:

| | |
|---|---|
| 97.0 gm | dimethyl terephthalate |
| 62.0 gm | ethylene glycol |
| 385.0 gm | polyethylene glycol of 1500 mol. wt. |
| 0.3 gm | butylated hydroxy toluene (antioxidant) |
| 0.15 gm | calcium acetate hydrate |
| 0.03 gm | antimony trioxide |

The flask was heated to 222° C. at which point distillation started. The temperature was increased gradually during the next four hours to 315° C. at which point 48 ml of distillate had been obtained.

At this point 0.6 gm of a 25% solution of phosphorous acid dissolved in ethylene glycol was added to the flask and a vacuum was applied to the flask to aid in further distillation. The temperature was held in the range of 305° to 311° C. while the vacuum was gradually increased to a maximum of 0.5 mm of mercury. The product was cooled to ambient temperature at which point it is a solid waxy material. A total of 61.7 gm of distillate was obtained during this reaction, thus yielding a final product weight of 483.4 grams. The amount of polyethylene glycol charged (385.0 gm) relative to the final product weight (483.4 gm) was about 80%. This product was not found to be water-soluble and it was necessary to disperse the insoluble product into water with a ball mill for a period of approximately eighteen hours in order to produce a useful product. A white dispersion resulted.

Based on the theoretical amount of methanol to be expected from this reaction (32.0 gm) the amount of ethylene glycol distilled was 29.7 grams. Therefore 32.2 gm of ethylene glycol (0.52 moles) was incorporated into the polymer. There was 0.257 moles of polyethylene glycol (PEG) used, thereby yielding a ratio of 0.49 of PEG to ethylene glycol.

EXAMPLE 2

(Compound B)

The following ingredients were put into a one-liter resin flask equipped as set forth in Example 1 above:

| | |
|---|---|
| 48.5 gm | dimethyl terephthalate |
| 27.13 gm | ethylene glycol |
| 385.0 gm | polyethylene glycol of 1500 mol. wt. |
| 0.3 gm | butylated hydroxyl toluene |
| 0.15 gm | calcium acetate hydrate |
| 0.03 gm | antimony trioxide |

The reaction was carried out similarly to the steps set forth in Example 1 above with 0.6 grams of a 25% phosphorous acid solution being added before applying the vacuum.

A total of 42.8 gm of distillate was obtained yielding a final product weight of 419.0 gm. The amount of polyethylene glycol charged (385.0 gm) was 92% of the final product weight. The product was a waxy solid which dissolved readily in water.

Using the theoretical amount of methanol (16.0 gm) there was 26.8 grams of ethylene glycol removed. This gives an incorporated ratio of PEG to ethylene glycol of 50.

EXAMPLE 3

(Compound C)

A one-liter round bottom flask was equipped with a stirrer, thermometer, distillation head with condenser, nitrogen inlet and heating mantle. Charged to this flask was:

| | |
|---|---|
| 41.53 gm | terephthalic acid |
| 27.13 gm | ethylene glycol |
| 362.50 gm | polyethylene glycol of 1450 mol. wt. |
| 0.06 gm | antimony trioxide |

The contents of the flask were heated to 240° C. and held at that temperature for a period of four hours during which time 16 ml of distillate was collected. Temperature was then raised to 280° C. over an hour. Vacuum was then gradually applied until 3 mm of mercury pressure was obtained. These conditions were maintained for one hour. The flask was then returned to atmospheric pressure by introduction of nitrogen gas and allowed to return to room temperature. Total distillate during this run was 32.7 grams. A waxy solid resulted which was readily soluble in water at 15% solids. Analysis of the waxy solid gave an acid value of 0.7 mg of KOH per gram of solid. A hydroxyl value of 20 mg of KOH per gram of solid was also determined. A relative viscosity measurement of a 5% aqueous solution of this product was 2.17 as determined in a capillary flow viscometer at 30° C. indicating the product to be a low molecular weight polymer.

Using the theoretical amount of water from this reaction (9.0 gm) there was 23.7 gm of ethylene glycol removed leaving 3.43 gm (0.055 moles) incorporated. This is a PEG to ethylene glycol ratio of 4.55.

EXAMPLE 4

An inclined wire pilot wet-laid nonwoven former was used to evaluate application of various polymer dispersants, including water-soluble materials, in the dispersion of polyester fibers during the preparation of a wet-laid nonwoven fiber mat.

A mix tank containing 500 liters of water was agitated continuously using a propeller type stirrer at 400 rpm. To this tank 100 grams of bleached softwood Kraft pulp and 400 grams of 1.5 Denier per fiber by ½" long polyester fibers were added. After the fiber addition, mixing was continued for 10 minutes before the start of web formation.

A wet-laid nonwoven web of basis weight 1.5 oz/yd$^2$ was formed by feeding the fiber/water mixture onto an inclined forming wire moving at a rate of 3 meters/minute. To aid in handling of the web, a small amount of a resinous binder was applied to the web before hot air drying.

The resultant sheet was examined visually for dispersion of the polyester fibers and overall uniformity. For this blank run, dispersion of the polyester fibers was very poor resulting in a sheet with poor overall formation.

The above sheet-forming process was repeated using chemical dispersant additions to the 500 liter water tank before addition of the wood pulp and synthetic fibers.

Milease T (a commercial dispersant sold by ICI Chemicals, Ltd.) was used as a standard for dispersion of polyester fibers. This product is believed to be an ethylene glycol/polyethylene glycol/dimethyl terephthalate polymer but is not soluble in water and is instead a dispersion of solid material in water. This product is widely used in the wet-laid nonwoven industry as a dispersant for polyethylene terephthalate fibers in water and is known to be effective in improving the overall formation of a wet-laid sheet incorporating polyethylene terephthalate (PET) fibers.

To evaluate dispersant activity, Milease T was added to the 500 liter mix tank before addition of the fiber furnish. The same procedure for mixing and forming a web outlined above was used. Milease T was added at 1.5 gm solids/500 gm fiber and 4.5 gm solids/500 gm fiber in separate runs. The polymer produced in Example 2 (Compound B) above was also evaluated using the same procedure at 1.5 gm solids/500 gm fiber and 4.5 gm solids/500 gm fiber in separate runs.

Performance of the chemical dispersants at equivalent levels was indistinguishable. At the 1.5 gm addition level, both the Milease T and the polymer of Compound B yielded minor improvements to dispersion of the polyester fibers in the finished sheet. Overall uniformity was slightly improved.

At the 4.5 gm addition level for both dispersants, dispersion of the polyester fibers was judged excellent and equivalent. Both finished sheets had good overall uniformity.

EXAMPLE 5

The mixing and sheet forming procedure outlined in Example 4 above was used with a fiber furnish consisting of only synthetic fiber (500 gm of 1.5 Denier per fiber by ½" long polyester).

Before addition of the fibers to the 500 liter mix tank, 50 ml of a 0.3% solution of a polyacrylamide "viscosity modifier" was added to the mix tank. Viscosity modifiers are often used in the wet-laid sheet forming process to minimize the tendency of long synthetic fiber to string together during mixing and processing. These "strings" of fibers produce an obvious defect in a wet-laid nonwoven web.

Again, separate sheet forming runs were performed using the synthetic fibers with viscosity modifier and either no dispersant additive or 4.5 gm of Milease T solids or 4.5 gm of Compound B. Milease T and Compound B being added to the mixing tank prior to the fiber addition.

The web produced using no dispersant exhibited poor overall uniformity with poor dispersion of the polyester fibers. The webs produced using the Milease T and Compound B were again indistinguishable and exhibited good dispersion of the polyester fibers and good overall uniformity.

EXAMPLE 6

Compounds A, B, and C described in Examples 1, 2, and 3 above, along with Milease T were evaluated for dispersant performance using a handsheet procedure.

Compound A was used in the ball milled dispersion form at 15% solids in water while compounds B and C were dissolved in water at a level of 15% solids.

Each dispersant was added to 2 liters of de-ionized water and allowed to mix for 20 seconds. 2 grams of 1.5 Denier per fiber by ¼" long polyester fibers were then added to the water/dispersant mixture and mixed for 40 seconds.

The water/fiber slurry was then poured into a handsheet mold, agitated manually, and drained to form a sheet. Handsheets were formed using 1, 2, 6 and 10 lbs. dispersant/ton of fiber for each of the dispersants. All mixtures containing a dispersant demonstrated considerable improvement over non-dispersant mixtures. The sheets were remarkably similar for all of the dispersants at a particular dose.

While we have shown and described several embodiments in accordance with our invention, it is to be clearly understood that the same are susceptible to numerous changes apparent to one skilled in the art. Therefore, we do not wish to be limited to the details shown and described but intend to show all changes and modifications which come within the scope of the appended claims.

What is claimed is:

1. A process for forming a wet-laid nonwoven fiber mat comprising:

adding a water-soluble dispersant to water, said water-soluble dispersant is a terpolymer formed from the distillation product of the monomers consisting of: (a) polyethylene glycol in an amount greater than about 80% by weight of said water-soluble dispersant; (b) a phthalic ester moiety derived from either a phthalic ester or a phthalic acid; and (c) a simple glycol selected from the group consisting of ethylene glycol, propylene glycol, neopentyl glycol and diethylene glycol, wherein said phthalic ester moiety and said simple glycol are present in an amount less than about 20% by weight of said water-soluble dispersant;

adding fibers to said water subsequent to addition of said water-soluble dispersant, thereby forming a fiber slurry;

mixing said fiber slurry; and forming a wet-laid nonwoven web from said mixed fiber slurry.

2. The process according to claim 1, wherein said water-soluble dispersant is added to said fibers in an amount in the range between about 0.02 to 5% of active solids based on fiber weight.

3. The process according to claim 1, wherein said water-soluble dispersant is added to said fibers in an amount in the range between about 0.04 to 1% of active solids based on fiber weight.

4. The process according to claim 1, wherein said fibers are polyethylene terephthalate fibers.

5. The process according to claim 1, wherein said fibers are synthetic fibers and/or natural fibers.

6. The process according to claim 1, wherein said phthalic ester is at least one material selected from the group consisting of: dimethyl terephthalate, dimethyl isophthalate, and dimethyl orthophthalate.

7. The process according to claim 1, wherein said water-soluble dispersant is a distillation product of polyethylene glycol, dimethyl terephthalate, ethylene glycol, butylated hydroxy toluene, calcium acetate hydrate, antimony trioxide, and a 25% solution of phosphorous acid dissolved in ethylene glycol.

8. The process according to claim 1, wherein said water-soluble dispersant is a distillation product of polyethylene glycol, terephthalic acid, ethylene glycol, and antimony trioxide.

9. The process according to claim 1, wherein a viscosity modifier is added to said water prior to addition of said fibers.

10. The process according to claim 9, wherein said viscosity modifier is a polyacrylamide viscosity modifier.

11. The process according to claim 9, wherein said viscosity modifier is added in an amount of about 10–100 ppm based on the total volume of water.

12. The process according to claim 1, wherein said phthalic acid is at least one material selected from the group consisting of: terephthalic acid, isophthalic acid, orthophthalic acid, and phthalic anhydride.

* * * * *